United States Patent [19]

Karolyi

[11] Patent Number: 5,028,043

[45] Date of Patent: Jul. 2, 1991

[54] SUCTION DEVICE FOR THE GRIPPING AND DECOLLATING OF THE BOTTOM BLANK OF A STACK OF BLANKS

[75] Inventor: Oskar Karolyi, Bad Boll, Fed. Rep. of Germany

[73] Assignee: Michael Horauf Maschinenfabrik GmbH & Co. KG, Donzdorf, Fed. Rep. of Germany

[21] Appl. No.: 552,831

[22] Filed: Jul. 16, 1990

Related U.S. Application Data

[63] Continuation of Ser. No. 301,844, Jan. 26, 1989, abandoned.

[30] Foreign Application Priority Data

Mar. 15, 1988 [DE] Fed. Rep. of Germany ..... 3808651

[51] Int. Cl.[5] ..... B65H 5/08

[52] U.S. Cl. ..... 271/14; 271/90; 271/95; 271/99; 271/112; 271/120; 271/132; 271/276; 294/64.1

[58] Field of Search ..... 271/21, 95, 100, 105, 271/106, 112, 120, 276, 90, 132, 11, 14; 294/64.1; 414/797.7, 797, 797.8

[56] References Cited

U.S. PATENT DOCUMENTS

| | | | |
|---|---|---|---|
| 1,942,527 | 1/1934 | Winkler et al. | 271/100 X |
| 2,111,024 | 3/1938 | Donnellan | 271/95 X |
| 2,745,665 | 5/1956 | Labombarde | 294/64.1 X |
| 3,154,306 | 1/1964 | Elliott et al. | 271/106 |
| 3,423,084 | 1/1969 | Konazewski | 271/100 |
| 3,521,879 | 7/1970 | Niemeyer | 271/95 |
| 3,773,318 | 11/1973 | Glaser et al. | 271/106 |
| 3,893,644 | 7/1975 | Thomsen | 271/100 |
| 3,976,292 | 8/1976 | Yoshida | 271/95 |
| 4,239,204 | 12/1980 | Miyagawa et al. | 271/95 X |
| 4,323,768 | 4/1982 | Uchida | 271/95 X |
| 4,428,815 | 2/1984 | Powell et al. | 294/64.1 |
| 4,564,188 | 1/1986 | McNair | 271/106 X |
| 4,669,716 | 6/1987 | VanderSyde et al. | 271/106 X |

FOREIGN PATENT DOCUMENTS

| | | | |
|---|---|---|---|
| 622076 | 10/1935 | Fed. Rep. of Germany | 271/95 |
| 1139851 | 11/1962 | Fed. Rep. of Germany | 271/95 |
| 2252302 | 10/1972 | Fed. Rep. of Germany | 271/95 |
| 0115871 | 9/1979 | Japan | 271/106 |
| 249834 | 10/1987 | Japan | 271/90 |
| 151112 | 8/1955 | Sweden | 271/95 |
| 309864 | 1/1930 | United Kingdom | 271/90 |
| 714009 | 8/1954 | United Kingdom | 271/95 |
| 1033930 | 6/1966 | United Kingdom | 271/95 |

*Primary Examiner*—Robert P. Olszewski
*Assistant Examiner*—Boris Milef
*Attorney, Agent, or Firm*—Burns, Doane, Swecker & Mathis

[57] ABSTRACT

A device for gripping and decollating a bottom blank comprises a rotary shaft with a flat outer peripheral portion. Suction orifices in the shaft extend through the flat surface portion and communicate with suction cups carried by the shaft. Free outer edges of the suction cups contact the bottom blank, whereupon the application of suction causes the suction cups to contract. The suction orifices include enlarged outer portions for receiving the contracted suction cups such that the bottom blank is pulled flush against the flat surface portion of the shaft for a more effective application of suction forces.

7 Claims, 2 Drawing Sheets

SUCTION DEVICE FOR THE GRIPPING AND DECOLLATING OF THE BOTTOM BLANK OF A STACK OF BLANKS

This application is a continuation of application Ser. No. 07/301,844, filed Jan. 26, 1989 now abandoned.

BACKGROUNDD OF THE INVENTION

The invention concerns an apparatus for the gripping and decollating of a bottom blank of a stack of blanks such as laminated paper blanks.

Apparatuses of this type are known (e.g., a block casing machine of the Horauf Maschinenfabrik GmbH & Co., West Gernamy). In this known configuration, the suction cups grip and bend down a blank to be decollated. The suction cups project through a flat surface of a rotary suction shaft. After the suction cups have made initial contact with the blank, the suction cups remain extended beyond that flat surface. This means that the blank to be bent down and decollated cannot rest flush against the flat surface, which may lead to difficulties in releasing the bottom blank from the stack, particularly if non-flat embossed or textile laminated book coverings are to be gripped. In such a case, dead air may be suctioned in whereby the gripping efficiency of the suction system is decreased.

It is, therefore, an object of the invention to eliminate this disadvantage and to provide an apparatus of the afore-mentioned type so that book lid coverings, especially those having a non-flat surface, may be gripped and decollated more securely.

SUMMARY OF THE INVENTION

This object is attained in an apparatus of the aforementioned type by a gripping apparatus comprising a rotary shaft and a plurality of elastic suction cups mounted in radial suction orifices of the shaft. The orifices are formed in a flat outer surface of the shaft. The suction cups have free outer ends which contact a bottom blank of a stack. A vacuum in the suction cups causes the blank to adhere to the suction cups, whereupon the suction cups contract to a position enabling the blank to lie flush against the flat surface of the shaft, which surface thus constitutes a support surface for the blank. As a result, the blank is always placed flat against the support surface. The blank is therefore always flat and in a defined position so that the suction cups are able to contact the material of the blank better. The entry of dead air is prevented.

The advantages of the invention makes it possible to use structural elements for the suction cups and to secure the functioning of the apparatus to simplify the production of the machine.

BRIEF DESCRIPTION OF THE DRAWING

The objects and advantages of the invention will become apparent from the following detailed description of a preferred embodiment thereof in connection with the accompanying drawing, in which like numerals designate like elements, and in which.

DETAILED DESCRIPTION OF A PREFERRED EMBODIMENT OF THE INVENTION

Figure 1:
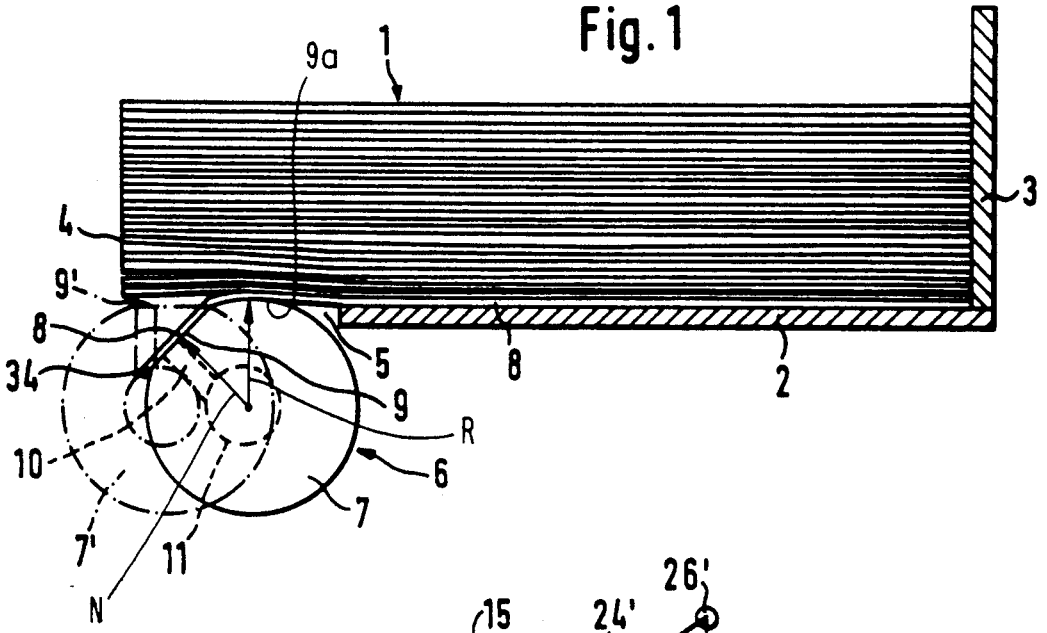
FIG. 1 is a side elevational view of a case decollating machine, located under a stack of blanks.

In FIG. 1, a stack of blanks of laminated paper or the like is supported at the bottom by a bottom plate 2 and aligned laterally by a stop 3. At the end 4 facing away from the stop 3, the bottom plate 2 is provided with a recess 5 which is engaged by a gripper comprising a suction shaft 7. The suction shaft 7 is able to grip the bottom blank 8 of the stack 1. In the process, an end of the blank 8 which is placed flush against a flat support surface 9 of the suction shaft 7, is bent downward by the rotation of the suction shaft 7, without being drawn from the stack 1. Different gripper elements are provided to subsequently draw the bottom blank 8 from the stack 1, but they are not part of the present invention and thus are not depicted.

Several suction orifices 10 are opening into the flat supporting surface 9 of the suction shaft 7, which orifices are connected to a vacuum manifold 11 extending coaxially within the suction shaft 7. The suction shaft 7 extends over the entire width of the stack 1. The shaft 7 may be moved the solid position from the position indicated by the broken lines in which the support surface 9 occupies a position 9' so as to abut the bottom blank 9 horizontally from below. In the process, the stack 1 is raised slightly in the zone of the suction shaft 7 of the gripper 6, whereby the release of the bottom blank is facilitated. That is, since the flat surface portion 9 constitutes a chord of a circular convex outer periphery of the shaft 7 (as the shaft is viewed in cross-section), the radius R from an axis of rotation of the shaft to a portion 9*a* of the circular outer periphery located adjacent a trailing edge 9*b* of the flat surface portion 9 is longer than a normal N from the axis to the flat surface portion 9. Accordingly, when the shaft rotates from the broken line position to the solid line position of FIG. 1, the portion 9*a* of the outer periphery contact and raises a portion of the stack.

The suction shaft 7 performs a two-fold movement to grip and bend down the bottom blank 8 from the stack 1, i.e., a rotating motion and secondly a simultaneous displacement parallel to the bottom plate 2. The corresponding kinematics is shown in FIG. 2.

Figure 2:
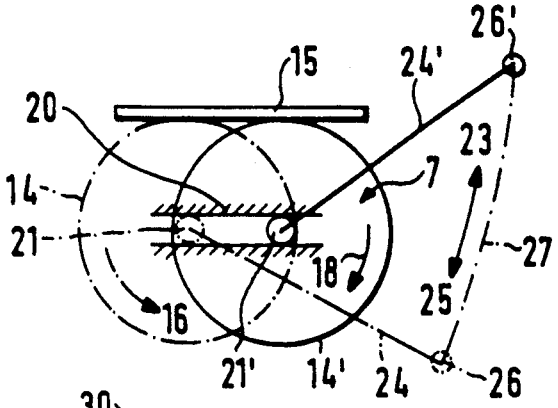
FIG. 2 is a schematic illustration of the kinematics of the suction shaft provided in the apparatus of FIG. 1 during a decollating step.

The suction shaft 7 is rotated by a toothed gear 14 shown by a broken line in FIG. 2, the gear being fastened coaxially to the suction shaft 7. The gear 14 engages a stationary tooth rack 15. Upon a displacement of the axle 21 of the suction shaft 7 parallel to the rack 15, the gear 14 and with it the suction shaft 7 rolls down the rack 15 and arrives in the solid line position 14'. In the process, the gear 14 and the suction shaft 7 carry out a rotating movement in the direction of the arrow 16. This displacement motion is attained by means of a lever 24, which may be moved into the position 24' by any suitable drive (not shown). The lever 24 is located with one end of the axle 21 of the suction shaft 7, upon which the gear 14 is also seated. With its other end, the lever 24 is being moved back and forth by means of a guide part 26 between the positions 26 and 26' in the direction of the two arrows 23 and 25 on a guide curve 27. This guide curve 27 may, for example, consist of a circular arc, which may be traversed from one end to the other by a lever (not shown) articulated at its other end onto a pivoting axle.

As readily seen in FIGS. 1 and 2, by means of the action represented in FIG. 2, the front end 34 of the bottom blank 8 is being gripped by the shaft 7 when the latter is in position 7'. Then the shaft is displaced and rotated so as to be brought into position 7, in which the front edge of the bottom sheet is downwardly bent. The bottom blank 8 as a whole is not being drawn out from the stack 1 by that operation, such drawing-out to be performed by other devices, as noted earlier. It is important that the suction shaft 7 is applied to the area of the terminal edge 34 of the bottom blank 8.

Figure 3A:
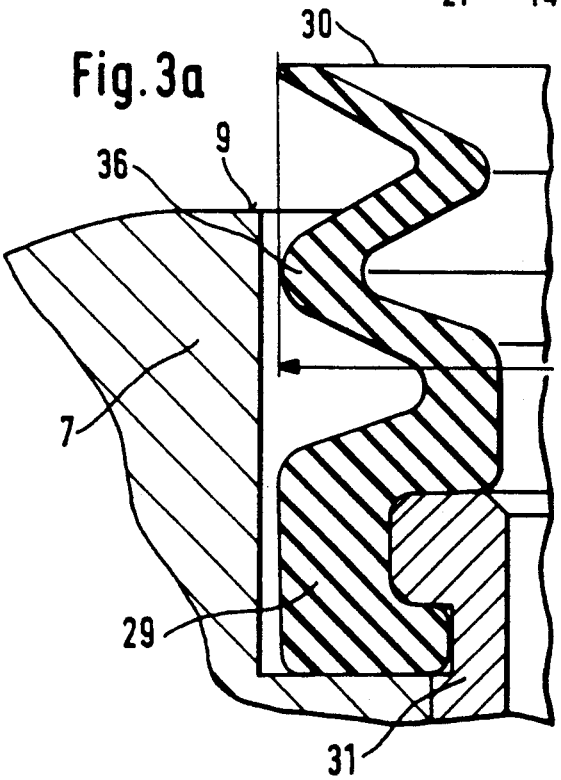
FIG. 3*a* is an enlarged cross-sectional view through a suction shaft and suction cup taken along a plane extending perpendicular to the shaft axis, depicting an initial extended position of the suction cup.
Figure 3B:
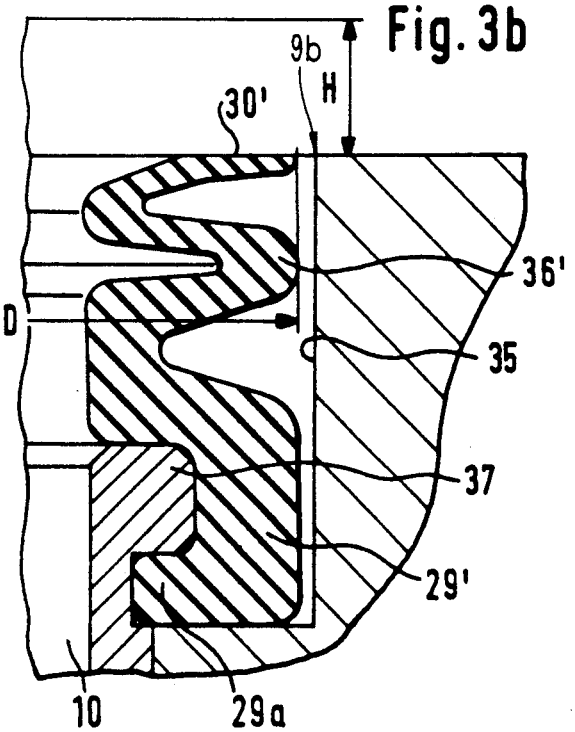
FIG. 3*b* is a view similar to FIG 3*a* depicting the retracted position occupied by the suction cup when a blank is suctioned thereon.
Figure 4:
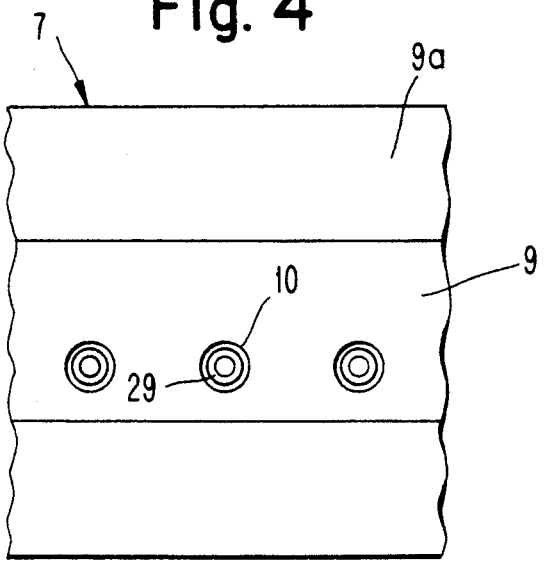
FIG. 4 is a fragmentary side elevational view of a suction shaft according to the present invention.

It is seen in FIGS. 3*a* and 3*b* that the suction orifices 10 of the suction shaft are equipped with suction cups 29. Each suction cup 29 comprise a folded bellows formed of an elastic material and having an outer or upper free end 30 which protects by an amount H beyond the support surface 9 of the suction shaft 7. The bellows-like suction cups 29 are located in enlarged portions 35 of the suction orifices. These enlargements 35 are basically cylindrical and have a diameter slightly larger than the largest outer diameter D of the essentially cyilindrical, bellows-like suction cups 29. The folded edges 36 of the bellows do not exceed the diameter D. Therefore, upon the application of the vacuum and the closure of the free ends of the bellows-like suction cups by their contact with the bottom blank, the bellows contract axially under the effect of the vacuum as depicted in FIG. 3*b*.

As seen in FIG. 3, the free edge 30 of the suction cup 29 is introduced into the enlargement 35 by the weight of the stack 29 pressing on the support surface 9 and the vacuum. When the shaft 7 is in the position 7' in FIG. 1, the front edge 34 of the bottom blank is gripped by the surface of the blank 8 by the suction effect. The bottom blank 8 is, therefore, resting with its front end 34 flatly on the support surface 9 and remains in this position, while the suction shaft carries out its rotating motion according to FIG. 2 and reaches its terminal position 7 in FIG. 1. The suction cup 29 then occupies position 29' shown in FIG. 3 and its free edge occupies the position 30'. The entire folding bellows is thus retracted by the deformation of the folded edges 36 into the position 36', wherein the surface of the flat free edge 30' lies in the plane of the surface 9.

The inherent elasticity of the bellows-like suction cups 29 ensures that the handling of an embossed paper blank no longer results in an unacceptable introduction of dead air. This advantage results from the flat lay of the blank 8 on the support surface 9. Even if the blank to be drawn off covers one suction cup 29 only, the latter descends not only under the weight of the stack, but also under the effect of the vacuum, whereupon the blank necessarily also comes into tight contact with the adjacent suction cups, even if the case of corrugated blanks or embossed coverings. Consequently, due to the vacuum effect, all of the suction cups are drawn down successively, until the entire bottom blank is resting flat.

As shown in FIGS. 3*a*, 3*b* the suction cups 29 are equipped at their inner or lower end with an inwardly facing edge 29*a*, positively gripping a fastening bead 37 of the end piece 31 of the suction orifices 10. The suction cups 29 may therefore be mounted in a simple manner by initially being set on the inserts 31 and then inserted into the corresponding orifices in the suction shaft 7.

The suction shaft 7 is equipped over its entire width with suction orifices 10, slightly spaced apart from each other. The suction orifices are ventilated by means of a valve (not shown) when the bent down and released bottom blank 8 is seized by the further gripping device (not shown) and drawn out from the stack 1. To facilitate this further seizing, a plurality of compressed air nozzles (not shown) may be provided in the bottom plate 2, which tend to slightly lift the bottom blank 8 from the bottom plate 2. Also, following the downward bending of the bottom blank 8, a plurality of blow nozzles may be arranged to direct air into the space formed between the blank 8 and the rest of the stack 1, so that the bottom blank 8 is floating on both sides on an air cushion while being drawn from the stack 1.

It is not absolutely necessary for the enlargements 35 to entirely surround the bellows-like suction cups 29 over their entire circumference. The aforedescribed functions and advantages are obtained also if the enlargements 35 are provided with lateral recesses, to be used, for example, to insert different structural parts into the area of the suction shaft.

Although the present invention has been described in connection with a preferred embodiment thereof, it will be appreciated by those skilled in the art that modifications, substitutions, additions, and deletions not specifically described may be made without departing from the spirit and scope of the invention as defined in the appended claims.

What is claimed is:

1. Apparatus for gripping and decollating a bottom blank of a stack of blanks for a book casing machine, said apparatus comprising:

a support plate on which the bottom blank is supported, said plate including recess means disposed beneath a portion of said bottom blank, and gripper means for gripping the bottom blank including:

a rotary shaft including an outer peripheral surface extending across a width of the bottom blank and protecting into said recess means, a portion of said outer peripheral surface being flat and extending across substantially the entire width of said bottom blank, and a plurality of suction orifices extending through said flat surface portion, outer edges of said orifices disposed in a plane of said flat surface portion is mutually spaced relationship, and a plurality of elastic suction cups mounted on said shaft within respective ones of said suction orifices, said suction cups having being extensible and contractible and including outer free edges arranged to enter said recess means and contact a portion of the bottom blank, said suction cups having open outer ends for transmitting suction to said portion of said bottom blank whereupon said suction cups tend to contract into respective suction orifices, each of said outer free edges comprising a flat surface laying in a common plane with said outer peripheral surface when said suction cup has been contracted, said suction orifices including enlarged portions extending inwardly from said flat surface portion of said shaft and sized for permitting said suction cups to contact into said suction orifices so that said portion of the bottom blank is pulled flush against said flat surface portion.

2. Apparatus according to claim 1, wherein said suction cups comprise elastic bellows arranged such that prior to contact with the bottom blank, said free edges thereof are disposed beyond said flat surface portion under the inheren elasticity of said bellows.

3. Apparatus according to claim 1, wherein a largest diameter of a compressible portion of said bellows is less than a diameter of said enlarged portion of said respective suction orifices.

4. Apparatus according to claim 3, wherein each of said suction orifices includes a fastening bead disposed at an inner end of said enlarged portion, an inner end of said bellows including a radially inwardly extending anchor portion seated behind said fastening bead for anchoring said bellows.

5. Apparatus according to claim 1, wherein said shaft is located adjacent a forward end of the stack of blanks, means provided for simultaneously rotating said shaft and displacing said shaft in a direction parallel to said bottom blank and transversely of the width of the bottom blank and away from said forward end for bending said portion of said bottom blank downwardly.

6. Apparatus according to claim 1, wherein a portion of said outer peripheral surface located adjacent a trailing edge of said flat surface portion is of convex shape and located farther from an axis of rotation of said shaft than a normal from said axis to said flat surface portion, whereby said convex-shaped portion contacts and raises a portion of said stack in response to rotation of said shaft.

7. Apparatus according to claim 6, wherein said outer peripheral surface is of circular cross-section, said flat surface portion constituting a chord of said circular outer periphery.

* * * * *